United States Patent [19]

Larws

[11] Patent Number: 4,519,786

[45] Date of Patent: May 28, 1985

[54] TOY-FIGURE

[76] Inventor: Peter Larws, Schlappmühler Pfad 13, D 6390 Usingen, Fed. Rep. of Germany

[21] Appl. No.: 506,976

[22] Filed: Jun. 23, 1983

[30] Foreign Application Priority Data

Jun. 23, 1982 [DE] Fed. Rep. of Germany ..... 3223358

[51] Int. Cl.[3] ..... A63H 3/16

[52] U.S. Cl. ..... 446/97; 446/376

[58] Field of Search ..... 446/124, 97, 268, 376, 446/378, 101, 377, 383, 99

[56] References Cited

U.S. PATENT DOCUMENTS 2,106,148 1/1938 Kellner ..... 446/97

3,995,395 12/1976 Rahmstorf ..... 446/100

4,203,248 5/1980 Tapdrup ..... 446/97

4,205,482 6/1980 Christiansen et al. ..... 446/97

*Primary Examiner*—Mickey Yu

*Attorney, Agent, or Firm*—Barnes & Thornburg

[57] ABSTRACT

A toy-figure or doll is provided which is especially configured and dimensioned for use in conjunction with a modular, plug-in-type building-block system with H-shaped block modules according to U.S. Pat. No. 3,838,535 (German Pat. No. 2,161,913). This toy-figure comprises movable arms, hands, legs and head. All measurements of the toy-figure and its component parts are sensibly adapted to the modular system which is based on a basic length unit a inasmuch as, for example, the length, breadth and depth of the figure, shoulder height, distance between the hands, grip-opening of the hands etc. all amount to whole-number multiples or fractions of the basic length unit a.

17 Claims, 4 Drawing Figures

FIG. 1a
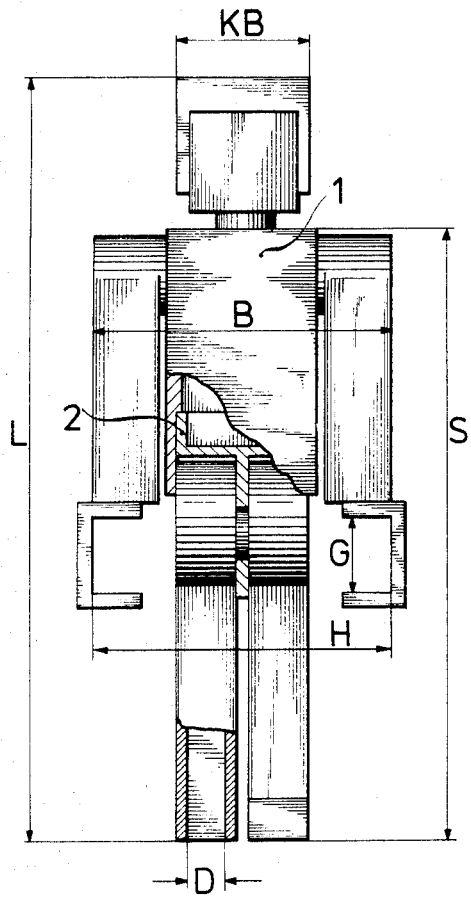
FIG. 1b
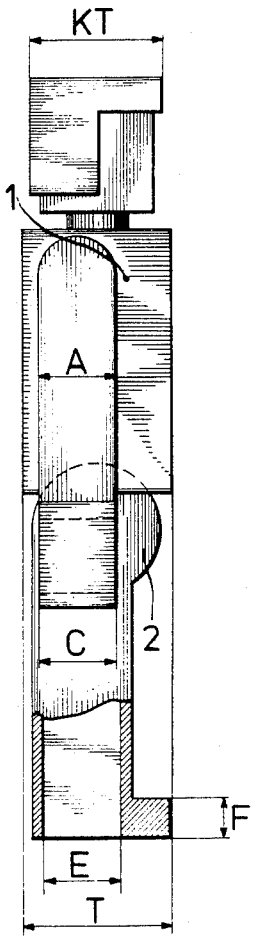
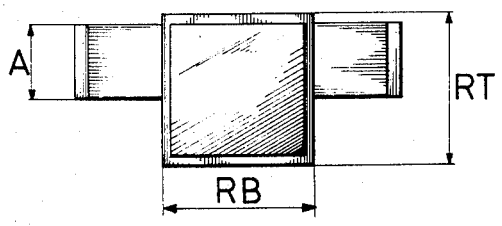
FIG. 1c

TOY-FIGURE

BACKGROUND AND SUMMARY OF THE INVENTION

The present invention relates to a toy-figure, or doll, suitable for use in conjunction with plug-in-type toy-building blocks of the type disclosed in (German Pat. No. 2,161,913) U.S. Pat. No. 3,838,535.

Toy-figures are known in a wide range of different forms, including figures which have movable arms, legs and heads. However, none of the known toy-figures is suitable for use in conjunction with the known plug-in-type building blocks according to the above-noted U.S. Pat. No. 3,838,535. The basic module of said modular plug-in-building system is an H-shaped brick, or block and the system dimensions are based on a basic length unit a.

The invention provides a doll or toy-figure advantageously configured for use with modular toy-building block systems of the plug-in-type using modules which are provided with passage openings having sides with a basic length a and whole number multiples of length a. In accordance with particularly preferred embodiments of the invention the toy-figure has the following measurements:

length or overall height: $L=5\times a$
height up to shoulder: $S=4\times a$
width across arms: $B=2\times a$
width of torso (side to side): $RB=a$
depth of torso (front to back): $RT=a$
depth of total figure (front to back): $T=a$
relative distance between rotatable hand-faces: $H=2a$
grip apertures of hands: $G=a/2$
width of head: KB≦a
depth of head: KT≦a.

In especially preferred embodiments the toy-figure is specifically dimensioned to be used with the system of U.S. Pat. No. 3,838,535 and the unit of length a corresponds to the unit of length a of said patent.

The toy-figure preferably has movable arms, hands, legs and a movable head and it is subdivided into a top part 1 and a bottom part 2. (See drawings). The top part can also be used separately and plugged into the passage opening (a×a) of the aforesaid patented building blocks.

The dimensions of the new toy-figure are sensibly adapted to the dimensions of the aforementioned modular building block system so that an optimum range of potential combinations with the building blocks is achieved. This includes the provision that the relative distance H of the rotatable hand-faces amounts to 2a, the grip-aperture G of the hands is a/2, the overall width B of the shoulders being 2a and the figure height S up to the shoulders being 4a.

Furthermore, preferably the width C of the hands=a/2 and the thickness A of the arms =a/2.

According to one particular advantageous feature of preferred embodiments of the invention, the legs of the toy-figure are hollow, the cross-sectional area of the hollow space D×E being equal to a/4×a/2.

These and further objects, features, and advantages of the present invention will become more obvious from the following description when taken in connection with the accompanying drawings which shows, for purposes of illustration only, a single embodiment in accordance with the present invention.

BRIEF DESCRIPTION OF THE DRAWINGS

FIG. 1*a* is a front view of a toy-figure constructed in accordance with the present invention;

FIG. 1*b* is a view from the side showing the left hand side of the toy-figure of of FIG. 1*a;*

FIG. 1*c* is a view from the top of the toy-figure of FIGS. 1*a* and 1*b.

DETAILED DESCRIPTION OF THE DRAWINGS

Figure 2:
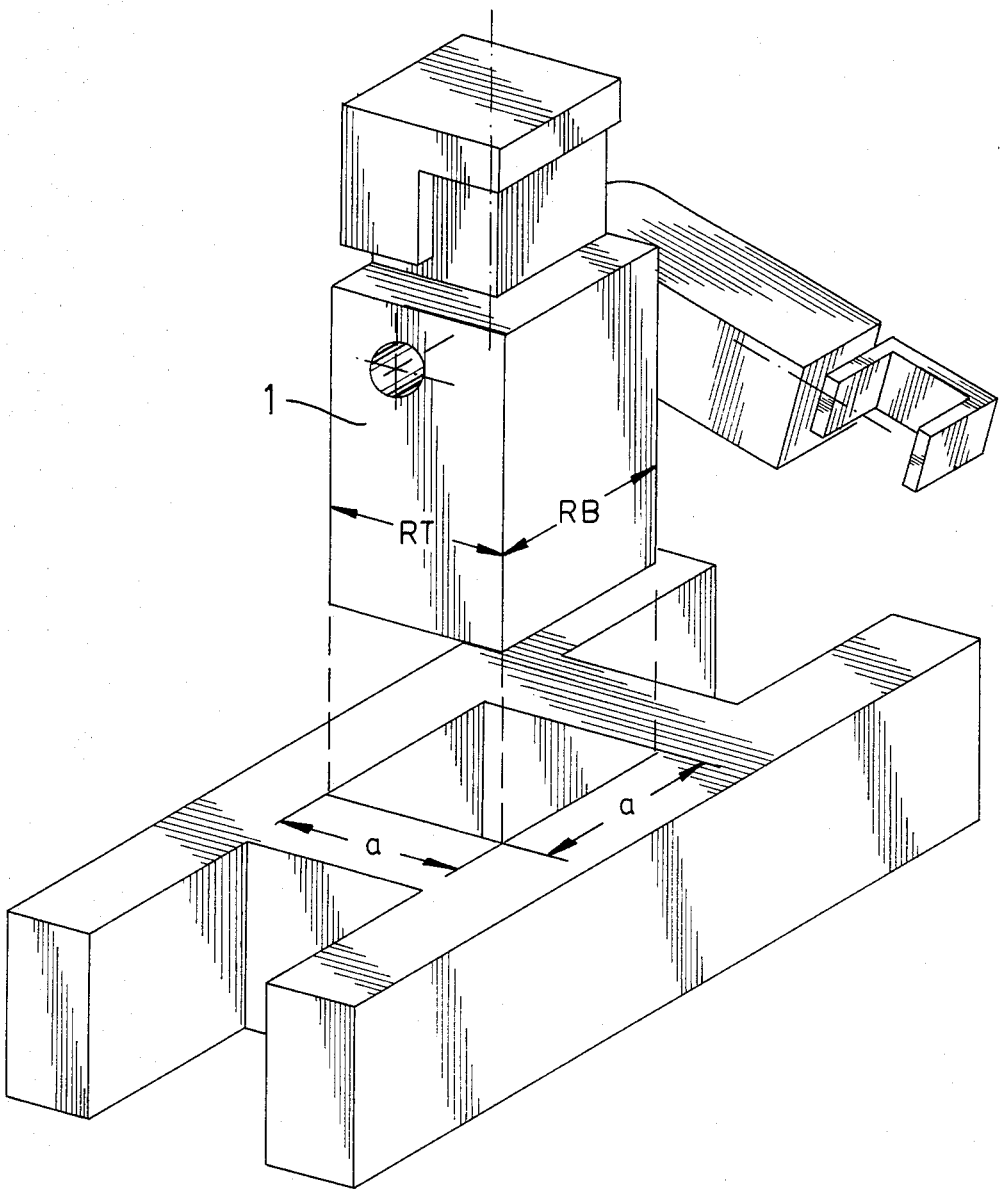
* and FIG. 2 is a perspective partly exploded view schematically depicting the top part of the toy-figure of FIGS. 1*a*–1*c* in operational conjunction with an H-block constructed in accordance with U.S. Pat. No. 3,838,535.

In order not to obscure the invention, the detailed structure accommodating the pivotal connection of the arms and legs and the rotatable connection of the head and hands is only generally shown and decribed. Those skilled in the art, given the present disclosure and the state of the art, will readily be able to construct toy-figures in accordance with the present invention.

As may be observed from the drawings, the toy-figure according to a preferred embodiment of this invention has the following measurements, with a being a selected unit length corresponding to the unit length "a" of U.S. Pat. No. 3,835,535:

length or overall height: $L=5\times a$
height up to shoulder: $S=4\times a$
width across arms: $B=2\times a$
width of torso (side to side): $RB=a$
depth of torso (front to back): $RT=a$
depth of total figure (front to back): $T=a$
relative distance between rotatable hand-faces: $H=2a$
grip apertures of hands: $G=a/2$
width of head: KB≦a
depth of head: KT≦a.
thickness of arms: $A=a/2$
width of hand: $C=a/2$
height of foot: $F=a/4$
cross-sectional area leg cavity: $D\times E=a/4\times a/2$.

It will be noted particularly from FIG. 2 that the top part 1 (torso RB×RT) of the toy-figure is also adapted to be inserted separately in the passage opening (a×a) of the aforementioned patented building blocks (U.S. Pat. No. 3,835,335). For this purpose, the lower part 2 containing the legs is detachably connected in the opening in the upper part 1. The toy-figure (doll) of the present invention, because of the selected configuration and dimensions of its parts, is especially adapted to be used and played with in conjunction with these patented building blocks. FIG. 2 is exemplary of the many combinations that can be made, the head movable arms, movable legs, hand grips and the like of the toy-figure being also dimensioned to be easily interengaged with the patented building blocks. The toy-figure can also be used alone or in interengagement with like-constructed toy-figures, as well as with other building block arrangements which have one or more openings conforming to the indicated dimensions.

The drawings show the correct relationship and shape (primarily rectangle or square cross-section to accommodate interengagement with other figures and building blocks) of the parts of the toy-figure of the invention.

While I have shown and described one embodiment in accordance with the present invention, it is understood that the same is not limited thereto but is susceptible to numerous changes and modifications as would be known to those skilled in the art of the present disclosure and I therefore do not wish to be limited to the details shown and described therein but intend to cover all such changes and modifications as are encompassed by the scope of the appended claims.

I claim:

1. A toy-figure with legs, arms, hands and a head, for use in conjunction with modular toy-building block systems of the plug-in-type using modules which are provided with rectangular passage openings, wherein the toy-figure has the following measurements:

width across arms: $B=2a$ width of torso: $RB=a$ depth of torso: $RT=a$ depth of total figure: $T=a$, a being the basic length unit of the modular building block system.

2. A toy-figure according to claim 1, wherein the basic unit length a corresponds to the unit length "a" of the building block system of U.S. Pat. No. 3,838,535.

3. A toy-figure according to claim 1, wherein the toy-figure also has the following measurements:

overall height: $L=5a$ height up to shoulders: $S=4a$

4. A toy-figure according to claim 1, wherein the toy-figure also has the following measurements:

relative distance between hand-faces: $H=2a$ grip aperture of hands: $G=a/2$.

5. A toy-figure according to claim 1, wherein the toy-figure also has the following measurements:

width of head: $KB \leqq a$ depth of head: $KT \leqq a$.

6. A toy-figure according to claim 3, wherein the toy-figure also has the following measurements:

relative distance between rotatable hand-faces: $H=2a$ grip aperture of hands: $G=a/2$.

7. A toy-figure according to claim 6, wherein the toy-figure also has the following measurements:

width of head: $KB=a$ depth of head: $KT=a$.

8. A toy-figure according to claim 1, wherein the toy-figure also has the following measurements:

width of head: $KB=a$ depth of head: $KT=a$.

9. A toy-figure according to claim 1, wherein the toy-figure consists of a top part, to which are secured the arms and the head of the figure, and of a bottom part adapted to be plugged into said top part and to be separated therefrom, to which are secured the legs of the figure.

10. A toy-figure according to claim 1, wherein the thickness of the arms A is equal to a/2 and the width of the hands C is equal to a/2.

11. A toy-figure according to claim 1, wherein the legs are hollow, the cross-sectional area of the hollow space $D \times E$ being equal to $a/4 \times a/2$.

12. A toy-figure according to claim 9, wherein the thickness of the arms A is equal to a/2 and the width of the hands C is equal to a/2.

13. A toy-figure according to claim 11, wherein the toy-figure consists of a top part, to which are secured the arms and the head of the figure, and of a bottom part adapted to be plugged into said top part and to be separated therefrom, to which are secured the legs of the figure.

14. A toy-figure according to claim 13, wherein the thickness of the arms A is equal to a/2 and the width of the hands C is equal to a/2.

15. A toy-figure according to claim 8, wherein the toy-figure consists of a top part, to which are secured the arms and the head of the figure, and of the bottom part adapted to be plugged into said top part and to be separated therefrom, to which are secured the legs of the figure.

16. A toy-figure according to claim 15, wherein the thickness of the arms A is equal to a/2 and the width of the hands C is equal to a/2.

17. A toy-figure according to claim 16, wherein the legs are hollow, the cross-sectional area of the hollow space $D \times E$ being equal to $a/4 \times a/2$.

* * * * *